US008358078B2

(12) United States Patent
Natarelli

(10) Patent No.: US 8,358,078 B2
(45) Date of Patent: Jan. 22, 2013

(54) FLUORESCENT LAMP DIMMER WITH MULTI-FUNCTION INTEGRATED CIRCUIT

(75) Inventor: David Natarelli, Victor, NY (US)

(73) Assignee: Technical Consumer Products, Inc., Aurora, OH (US)

( * ) Notice: Subject to any disclaimer, the term of this patent is extended or adjusted under 35 U.S.C. 154(b) by 609 days.

(21) Appl. No.: 12/242,303

(22) Filed: Sep. 30, 2008

(65) Prior Publication Data

US 2009/0302772 A1 Dec. 10, 2009

Related U.S. Application Data

(60) Provisional application No. 61/060,006, filed on Jun. 9, 2008.

(51) Int. Cl.

| | |
|---|---|
| ***H05B 37/02*** | (2006.01) |
| ***H05B 39/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/14* | (2006.01) |
| *H05B 41/16* | (2006.01) |
| *H05B 41/24* | (2006.01) |
| *H01J 11/04* | (2006.01) |
| *H01J 13/48* | (2006.01) |
| *H01J 15/04* | (2006.01) |
| *H01J 17/36* | (2006.01) |

(52) U.S. Cl. ..... 315/209 R; 315/200 R; 315/247; 315/291; 315/326

(58) Field of Classification Search ..... None
See application file for complete search history.

(56) References Cited

U.S. PATENT DOCUMENTS

| | | | | |
|---|---|---|---|---|
| 5,315,214 | A * | 5/1994 | Lesea | 315/209 R |
| 5,384,516 | A * | 1/1995 | Kawabata et al. | 315/160 |
| 5,559,395 | A | 9/1996 | Venkitasubrahmanian et al. | |
| 5,965,985 | A | 10/1999 | Nerone | |
| 6,037,722 | A * | 3/2000 | Moisin | 315/307 |
| 6,366,474 | B1 * | 4/2002 | Gucyski | 363/20 |
| 6,545,431 | B2 * | 4/2003 | Hui et al. | 315/291 |
| 6,603,274 | B2 | 8/2003 | Ribarich et al. | |
| 6,642,669 | B1 * | 11/2003 | MacAdam et al. | 315/244 |

(Continued)

OTHER PUBLICATIONS

Van Valkenburg, Mac. E & Midleton, Wendy.Reference Datafor Engineers: Radio, Electronics, Computer, and Communications[online].Ninth Edition.Newnes.2002[retrieved on May 16, 2011]. Retrieved from the Internet<URL:http://books.google.com/books>.*

(Continued)

*Primary Examiner* — Douglas W Owens
*Assistant Examiner* — Dedei K Hammond
(74) *Attorney, Agent, or Firm* — Benesch, Friedlander, Copland & Aronoff, LLP

(57) ABSTRACT

In one embodiment, a fluorescent lamp dimming circuit includes power factor correction control, dimming control, and switching devices. The power factor correction control may be connected to power factor correction circuitry that produces a regulated DC buss. The dimming control circuit may be connected to the input of the fluorescent lamp dimming circuit for producing a driver signal whose frequency varies depending on the input voltage waveform perhaps as modified by a dimmer. The control circuit may produce a drive signal with a duty cycle profile to drive switching devices. The switching devices invert the DC buss voltage to an AC voltage waveform for driving a resonant tank circuit. The resonant tank circuit may include an inductance, a capacitance, and the impedance of a fluorescent lamp. The AC voltage waveform when applied to the resonant tank circuit may cause the fluorescent lamp to dim based on the dimmer setting.

8 Claims, 9 Drawing Sheets

U.S. PATENT DOCUMENTS

| | | | | |
|---|---|---|---|---|
| 6,998,795 | B2 | 2/2006 | Chiou | |
| 7,148,633 | B2 * | 12/2006 | Yu et al. | 315/224 |
| 7,211,966 | B2 | 5/2007 | Green et a | |
| 2002/0135320 | A1 | 9/2002 | Kominami et al. | |
| 2002/0140373 | A1 | 10/2002 | Ribarich et al. | |
| 2003/0062841 | A1 | 4/2003 | Norling | |
| 2003/0080696 | A1 | 5/2003 | Tang et al. | |
| 2004/0109317 | A1 | 6/2004 | Ribarich | |
| 2004/0113564 | A1 | 6/2004 | Glaser et al. | |
| 2005/0184682 | A1 | 8/2005 | Ribarich | |
| 2005/0218839 | A1 * | 10/2005 | Ribarich | 315/307 |
| 2005/0269964 | A1 * | 12/2005 | Ravindra et al. | 315/209 R |
| 2007/0085488 | A1 | 4/2007 | Ribarich et al. | |
| 2007/0090775 | A1 | 4/2007 | Ribarich | |
| 2007/0108915 | A1 | 5/2007 | Ribarich | |
| 2007/0188103 | A1 | 8/2007 | Ribarich | |
| 2008/0030148 | A1 | 2/2008 | Tang et al. | |
| 2008/0278086 | A1 * | 11/2008 | Chitta et al. | 315/224 |

OTHER PUBLICATIONS

Bongers, Joost, et al.Application Note: CFL Applications with the UBA2024T.2003[retieved on May 17, 2011].Retrieved from the Internet<URL:http://www.nxp.com/documents/application_note/AN_UBA2024T.pdf>.*

* cited by examiner

FLUORESCENT LAMP DIMMER WITH MULTI-FUNCTION INTEGRATED CIRCUIT

This application claims the benefit of U.S. Provisional Application 61/060,006 filed Jun. 9, 2008, which is incorporated herein by reference.

BACKGROUND

This application relates in general to lighting systems and particularly to fluorescent lighting with dimming capabilities.

Many residential and commercial light dimming applications are fitted with triac based dimmers, also known as phase chop dimmers. These dimmers work by removing or chopping parts of the AC input voltage waveform to the lamp. These dimmers work well with ordinary incandescent light bulbs because the removal or chopping of the voltage waveform reduces the power transfer to the light bulb hence achieving dimming. However, these triac based dimmers do not work well with conventional fluorescent lamp circuits because the input waveform to a fluorescent lamp circuit is not injected directly into the filaments of a lamp as with incandescent lamps, but the waveform is injected into a fluorescent lamp circuit sometimes called a ballast circuit. The ballast circuit's response to the chopped waveform is unsatisfactory and does not achieve dimming.

Because, triac based dimmers are common both in residential and commercial applications, a fluorescent lamp dimming circuit that operates with a triac based dimmer is desirable.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

The following includes definitions of selected terms employed herein. The definitions include various examples and/or forms of components that fall within the scope of a term and that may be used for implementation. The examples are not intended to be limiting. Both singular and plural forms of terms may be within the definitions.

"Signal," as used herein, includes but is not limited to one or more electrical or optical signals, analog or digital signals, data, one or more computer or processor instructions, messages, a bit or bit stream, or other means that can be received, transmitted and/or detected.

"User," as used herein, includes but is not limited to one or more persons, software, computers or other devices, or combinations of these.

"Operatively connected," as used herein, is not limited to mechanical or electrical connections, but includes means of connection where the components together perform a designated function.

Figure 1:
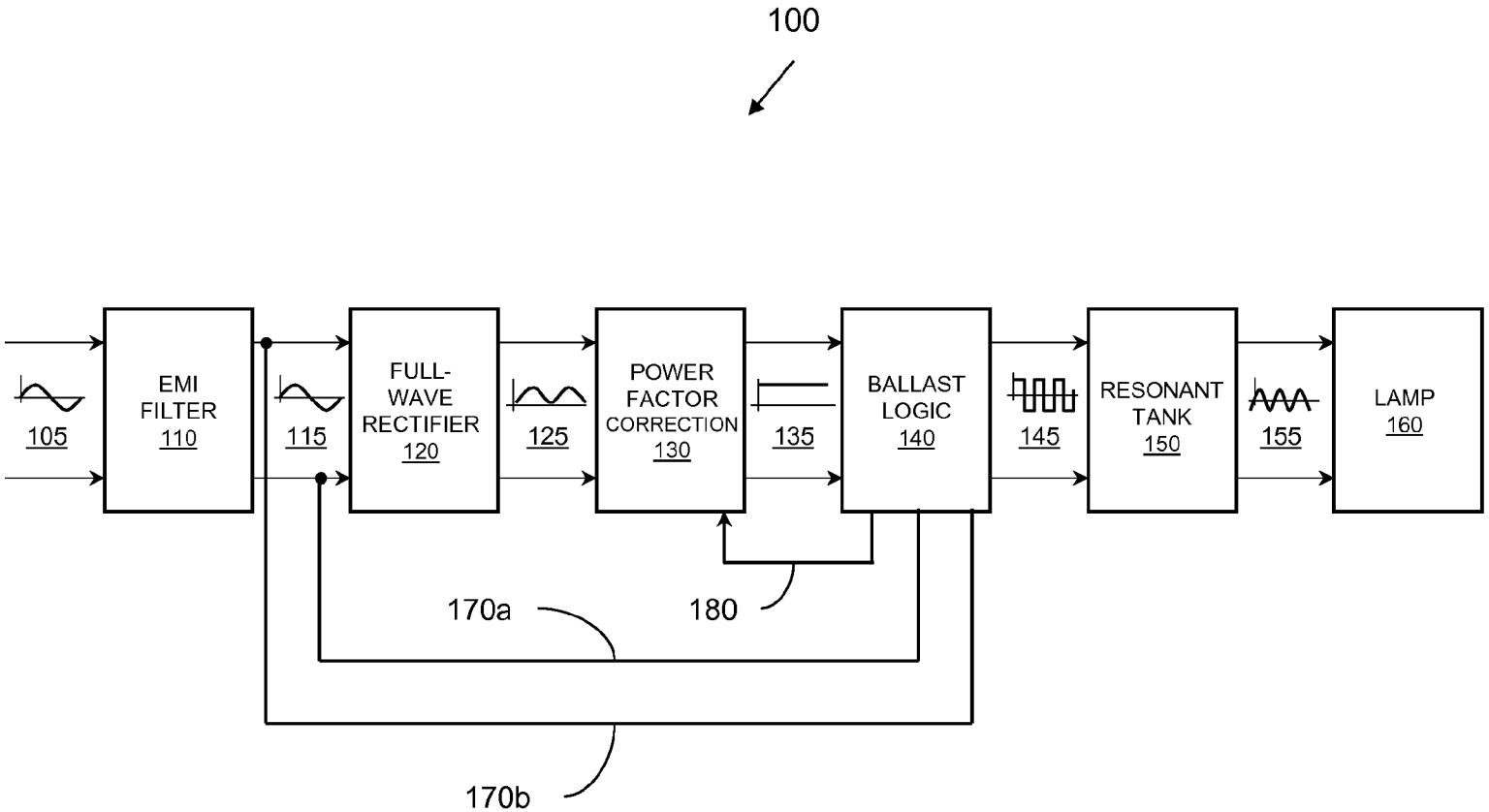
FIG. 1 illustrates an example block diagram of a fluorescent lamp dimming circuit.

FIG. 1 illustrates an example block diagram of a fluorescent lamp dimming circuit 100. Circuit 100 is designed to connect to domestic or commercial AC service. Therefore, the input to circuit 100 is usually an AC voltage 105. It should be noticed that the input to circuit 100 may also be a DC voltage (not shown). Circuit 100 may include near its input an electromagnetic interference ("EMI") filter 110. Filter 110 may be configured for circuit 100 to comply with EMI standards (e.g. Federal Communications Commission ("FCC") emissions and immunity standards, and so on).

Circuit 100 may also include a full-wave rectifier 120. Full-wave rectifier 120 converts AC line voltage 105 or post-filter AC line voltage 115 to a DC voltage 125. DC voltage 125 may contain a significant ripple component. Circuit 100 may include power factor correction circuitry ("PFC") 130. In one embodiment, PFC 130 may perform active power factor correction. Active power factor correction is a power electronics system that controls the amount of power drawn by a load, in this case the lamp circuit, in order to obtain a power factor as close as possible to unity. PFC 130 controls the input current of the lamp circuit so that the input current waveform is proportional to the AC line voltage waveform. PFC 130 may also include a converter which attempts to maintain a regulated DC buss voltage 135 at the output of PFC 130 while drawing a current that is in phase with and at the same frequency as post-filter AC line voltage 115.

Circuit 100 may incorporate ballast logic 140. Ballast logic 140 may perform multiple functions. One of these functions may include power factor correction control for controlling PFC 130. In this embodiment, ballast logic 140 controls PFC 130 via a signal sent through connection 180. Ballast logic 140 may perform dimming control for controlling the dimming level of fluorescent lamp 160, and switching for inverting the DC buss voltage 135 to an AC voltage 145 based on a drive signal from the dimming control. The resulting AC voltage 145 may be used to drive resonant tank 150. In one embodiment, resonant tank 150 includes an inductance, and a capacitance. Together resonant tank 150 and the impedance of lamp 160 form an RLC resonance circuit. The inductance may be the inductance of the primary of a transformer in resonant tank 150. The turns ratio of the transformer in resonant tank 150 may be designed to step up the amplitude of AC voltage 145 to a suitable voltage for lamp voltage 155 to properly power lamp 160.

At start up, ballast logic 140 may adjust the frequency of AC voltage 145 so that when AC voltage 145 is injected into the primary side of resonant tank 150, the frequency of AC voltage 145 and lamp voltage 155 at the secondary side of resonant tank 150 is above the resonance frequency of the combination of lamp 160 and resonant tank 150. During this time the filaments of lamp 160 preheat. After preheat, ballast logic 140 may adjust down the frequency of AC voltage 145. This will cause the lamp voltage 155 to increase as the frequency of AC voltage 145 lowers toward the resonance frequency of the combination of lamp 160 and resonant tank 150. The high amplitude of lamp voltage 155 during this resonant start up time eventually causes the gas in fluorescent lamp 160 to radiate light. After fluorescent lamp 160 has ignited, ballast logic 140 may further decrease the frequency of AC voltage 145 to move beyond resonance and towards steady state operation.

In one embodiment, after startup, ballast logic 140 may modify the frequency, duty cycle and/or amplitude of AC voltage 145 to correspond to the dimmer setting as measured by ballast logic 140 from post-filter AC line voltage 115 modified by a dimmer (not shown). Ballast logic 140 may sample or measure post-filter AC line voltage 115 via connections 170*a* and 170*b*. In a particular embodiment, based on post-filter AC line voltage 115, ballast logic 140 may vary DC buss voltage 135 via connection 180 to PFC 130. By varying DC buss voltage 135, ballast logic 140 also varies the amplitude of AC voltage 145 and the amplitude of lamp voltage 155. In another embodiment, ballast logic 140 may vary the frequency and/or duty cycle of AC voltage 145 which also varies the frequency and/or duty cycle of lamp voltage 155. As a user modifies post-filter AC line voltage 115 by operating a dimmer connected to circuit 100, ballast logic 140 may vary the frequency, the duty cycle, the amplitude or any combination of the three parameters of AC voltage 145 and lamp voltage 155 to cause lamp 160 to dim accordingly.

Figure 2:
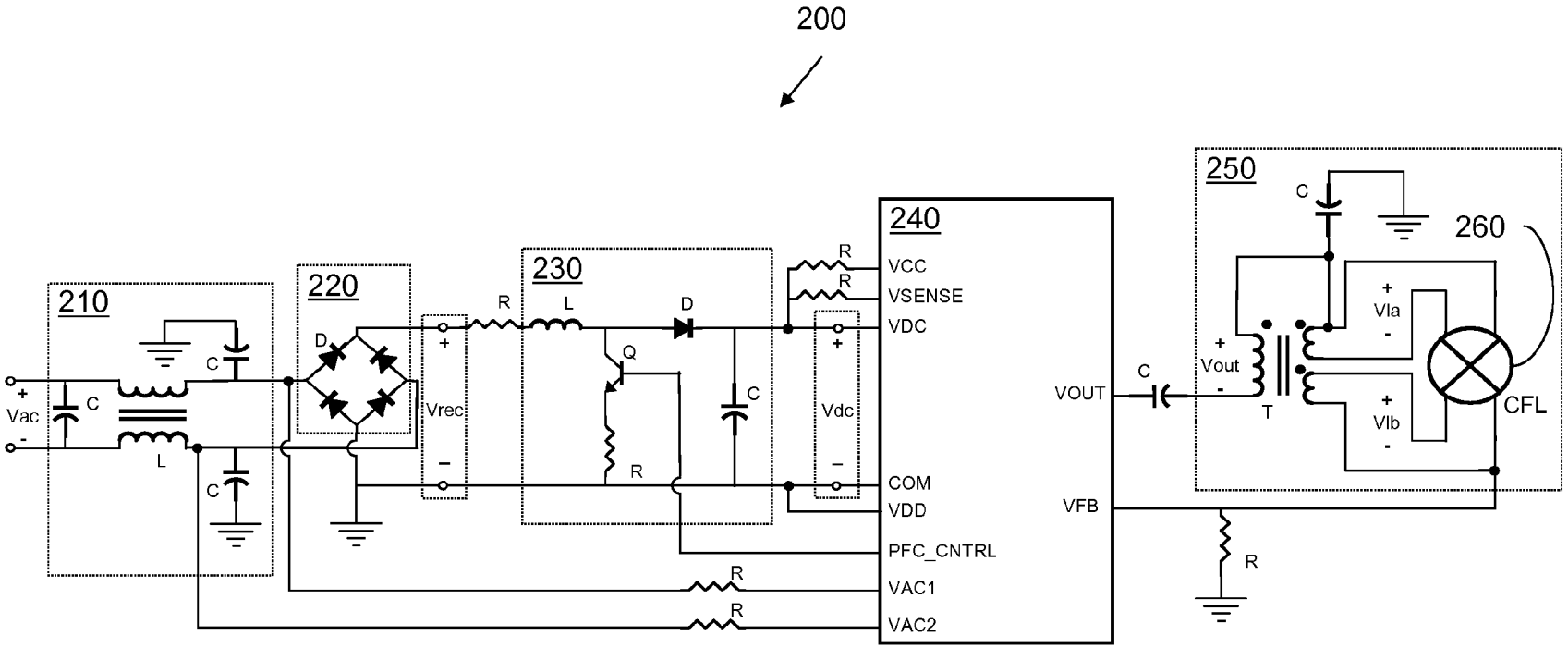
FIG. 2 illustrates an example schematic diagram of a fluorescent lamp dimming circuit.

Referring now to FIG. 2, another example of a fluorescent lamp dimming circuit 200 may include an EMI filter 210. Filter 210 may be one of many topologies known in the art to achieve compliance with agency regulation regarding electromagnetic emissions. Circuit 200 may also include a full-wave rectifier 220. Full-wave rectifier 220 rectifies AC voltage Vac into DC voltage Vrec. Vrec, although DC, may contain significant ripple. Circuit 200 may also include PFC circuitry 230. PFC circuitry 230 may be configured as one of many topologies known in the art. One topology may be a boost converter topology. A boost converter includes an inductor L, a switching device Q (e.g. MOSFET, BJT, IGBT), a diode D, and a capacitor C. Configured in a boost converter topology, PFC circuitry 230 boosts voltage Vrec up to a regulated DC buss voltage Vdc.

Example circuit 200 also includes an integrated circuit ("IC") 240. IC 240 performs multiple functions including power factor correction control for controlling PFC circuitry 230. IC 240 connects to PFC circuitry 230 via pin PFC_CNTRL. PFC_CNTRL provides a signal to PFC circuitry 230 that drives the switching device Q. IC 240 measures AC line voltage Vac via pins VAC1 and VAC2. IC 240 also samples DC buss voltage Vdc via pin VSENSE. Using this information, IC 240 may control PFC circuitry 230 and in particular switching device Q via pin PFC_CNTRL to regulate or maintain the DC buss voltage Vdc while drawing current in phase and at the same frequency as Vac.

IC 240 may also perform switching for inverting the DC buss voltage Vdc to an AC voltage Vout. IC 240 controls the frequency and duty cycle of Vout. Vout in turn is the input to resonant tank 250. Resonant tank 250 may be configured in one of many different schemes known in the art to achieve start of lamp 260 depending on lamp characteristics or electrical needs. In this example, resonant tank 250 includes a transformer T with a built in inductance and a capacitor C. Transformer T is designed such that its built-in inductance resonates with capacitor C and the impedance of lamp 260 at a desired frequency. The inductance of resonant tank 250 may also be in the form of a discrete inductor L (not shown.) Transformer T may also have a turns ratio that provides a voltage step up at the secondary of T making voltages V1*a* and V1*b* of the proper amplitude to keep lamp 260 lit during steady state operation.

IC 240 also performs dimming control for controlling the dimming level of fluorescent lamp 260. IC 240 determines the dimmer level by measuring AC line voltage Vac via pins VAC1 and VAC2. Therefore, when a user changes a dimmer setting, IC 240 measures the user's desired dimming level at Vac and changes the light output of lamp 260 by changing one or more of Vdc, the frequency of Vout and the duty cycle of Vout. These changes in turn change one or more of the amplitude, the frequency and the duty cycle of lamp voltages V1*a* and V1*b*. IC 240, by use of closed loop feedback control constantly monitors lamp 260's current via pin VFB and adjusts the amplitude, frequency and/or duty cycle of the lamp voltages Vout, V1*a* and V1*b* to achieve the desired dimming level.

Figure 3:
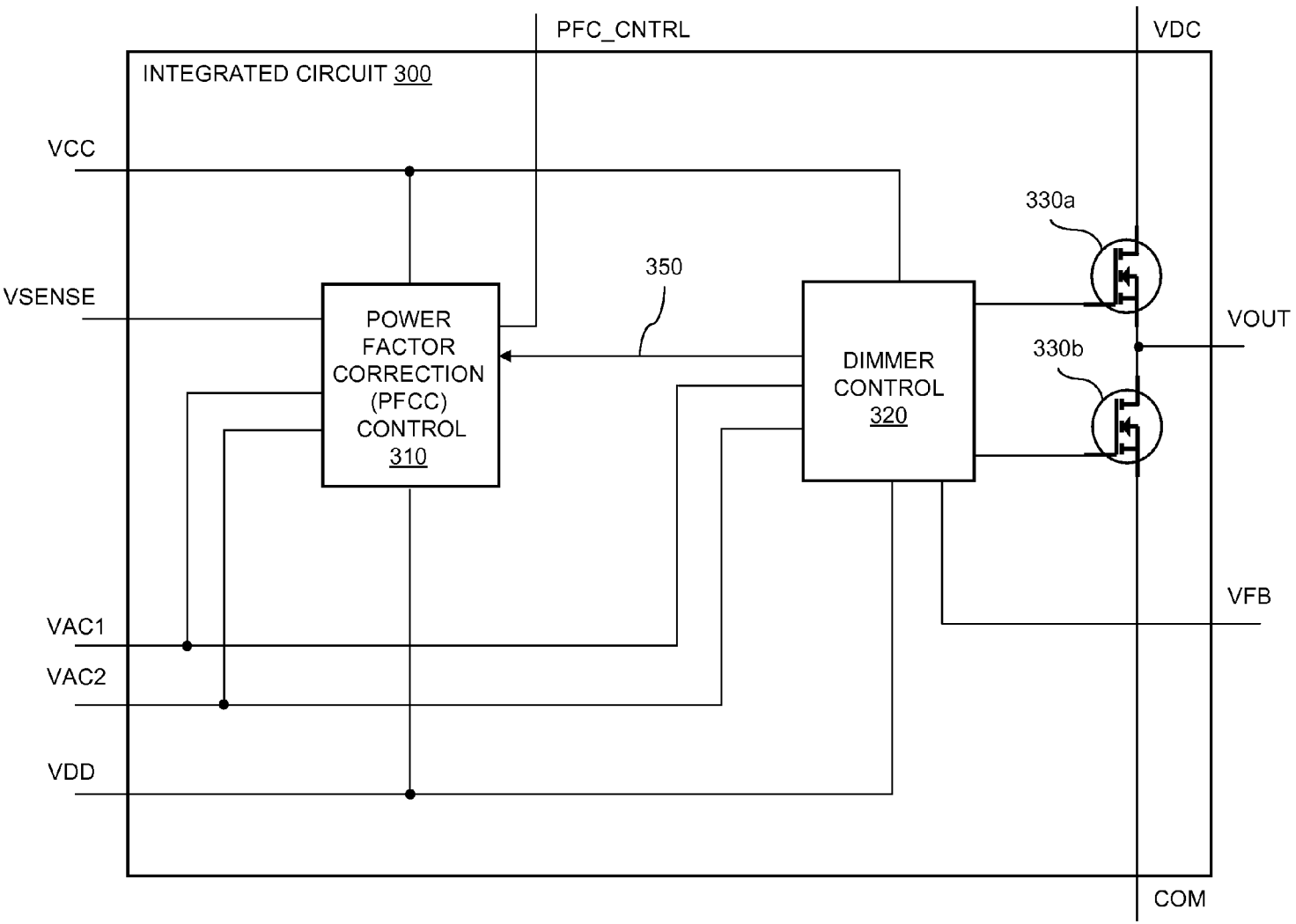
FIG. 3 illustrates an example block diagram of an integrated circuit for a fluorescent lamp dimming circuit.

Referring now to FIG. 3, one embodiment of a fluorescent lamp dimming circuit comprises an integrated circuit ("IC") 300. Example IC 300 includes a power factor correction control ("PFCC") circuit 310. PFCC 310 may include connections to VAC1 and VAC2 which are themselves connected to the AC input of the fluorescent lamp dimming circuit. PFCC 310 connects to the AC input so that PFCC 310 can monitor the voltage waveform of the AC input to the fluorescent lamp dimming circuit. PFCC 310 also monitors a DC voltage that PFCC regulates via VSENSE. In one embodiment, the regulation voltage for the DC voltage may be constant. In another embodiment, PFCC 310 may also receive a signal 350 from Dimmer Control 320. This signal 350 sets the regulation set point for the DC voltage. This means that the voltage at VSENSE may vary depending on a dimmer setting. PFCC 310 controls PFC circuitry 230 via PFC_CNTRL. In this embodiment, using the inputs VSENSE, VAC1-VAC2, and signal 350, PFCC 310 attempts to regulate the DC voltage to the level indicated by dimming control 320 while attempting to keep a power factor close to unity.

Example IC 300 also includes Dimmer Control 320. Dimmer Control 320 receives the dimmer setting information from the AC input to the fluorescent lamp dimming circuit via connections to VAC1 and VAC2. Dimmer Control 320 attempts to control the light output of the fluorescent lamp based on the dimmer setting by regulating the lamp current via pin VFB in a closed loop control arrangement. In one embodiment, Dimmer Control 320 may vary the amplitude of the lamp voltage by varying the regulation voltage of VDC sensed at VSENSE via signal 350 to PFCC 310. Varying the amplitude of the lamp voltage accomplishes some level of dimming. Dimmer Control 320 may also vary the frequency and/or duty cycle of the lamp voltage. Dimmer Control 320 produces a drive signal which drives switching devices 330*a* and 330*b*. These devices may be one of many types known in the art (e.g. MOSFET, BJT, IGBT). These devices are integrated into IC 300 reducing the parts count and assembly time of the fluorescent lamp dimming circuit. Switching devices 330*a* and 330*b* are connected to VDC to invert voltage VDC into voltage VOUT. VOUT, in turn, drives a resonant tank which is operably connected to the fluorescent lamp. Varying the frequency and/or duty cycle of VOUT may vary the light output of the fluorescent lamp accomplishing dimming.

In another embodiment, varying the duty cycle of VOUT may improve the overall efficiency of the ballast circuit. Power losses in switching devices, such as example switching devices 330*a* and 330*b*, are often a significant contributor to overall circuit losses. Power losses $P_{loss}$ in a switching device have two main components: switching losses $P_{switch}$ and conduction losses $P_{cond}$.

$$P_{loss}=P_{switch}+P_{cond}$$

Switching losses $P_{switch}$ may be defined as those losses associated with turning the switching device on and off. Conduction losses $P_{cond}$ may be defined as those losses associated with conducting current during the time the device is on. Assuming, for simplicity, that switching losses $P_{switch}$ are constant at a fixed frequency, reducing conduction losses $P_{cond}$ would reduce total power loss $P_{loss}$ in the switching device.

For an example MOSFET, conduction losses $P_{cond}$ equal the on-time $t_{on}$ times the square of the drain current $i_D$ times the on resistance $R_{DSon}$ divided by the period T.

$$P_{cond} = \frac{t_{on} i_D^2 R_{DSon}}{T},$$

$$\text{where } T = \frac{1}{f}$$

Duty cycle δ equals the on-time $t_{on}$ divided by the period T.

$$\delta = \frac{t_{on}}{T}$$

Thus, $$P_{cond}=\delta i_D^2 R_{DSon}$$

Assuming, for simplicity, that $R_{DSon}$ is constant, as long as $i_D^2$ does not increase at a rate faster than the rate of reduction in duty cycle δ, reducing duty cycle δ reduces conduction losses $P_{cond}$. Thus, reducing the duty cycle may lower losses in the switching devices and may increase overall efficiency of the ballast circuit.

Resonant tank 250 includes an inductance L that may be in the form of a built-in inductance in transformer T or a stand alone inductor (not shown). Power Losses in this output/resonant inductance L also contribute significantly to overall circuit losses. Current flowing through inductor L causes the inductor to heat up creating circuit power losses in the form of heat and, hence, reducing circuit efficiency. These losses may be approximated by $P_L=i_L^2 \cdot Z$ where Z equals the parallel sum of the DC resistance, and the impedance of the inductor at a specified frequency. In addition, parasitic circuit elements may cause additional current flow through the inductor contributing to circuit losses. Controlling the current $i_L$ provides means to control power losses in inductance L and improve circuit efficiency.

Figure 9:
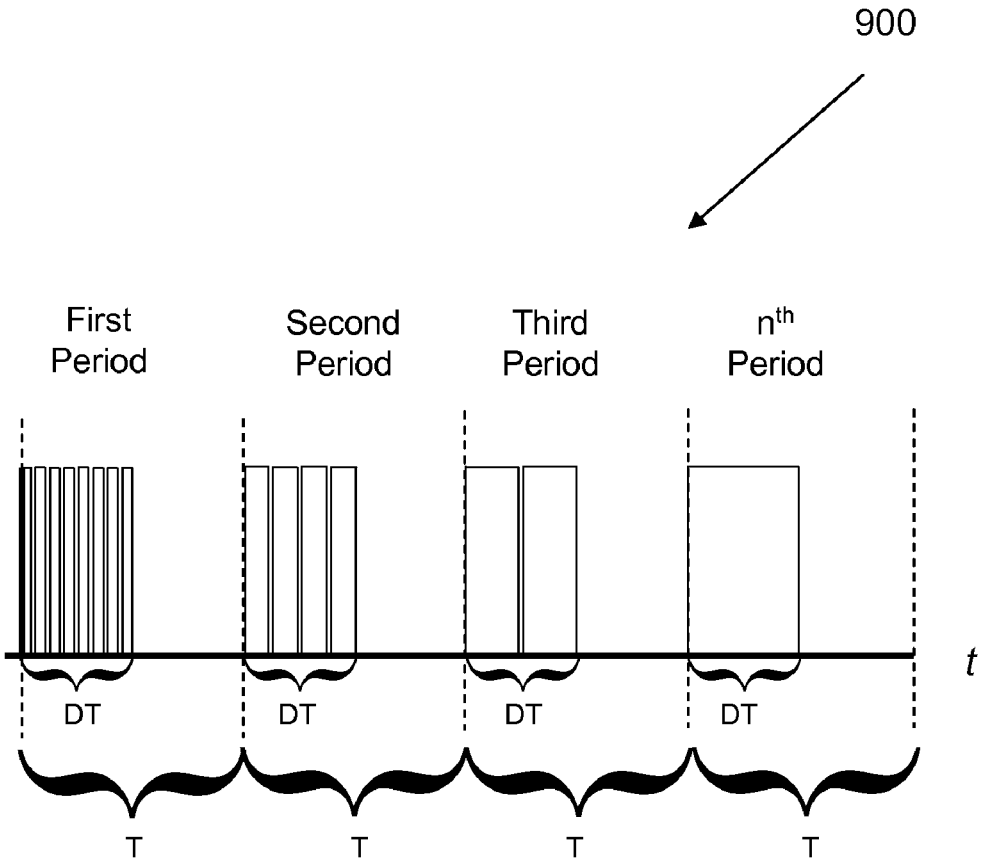
FIG. 9 illustrates an example duty cycle profile.

Referring now to FIG. 9, in one example embodiment, the current $i_L$ is controlled by use of duty cycle profile 900. Duty cycle profile 900 may help reduce power losses by "walking in" the current. By walking in the current, duty cycle profile 900 does not allow the inductor current $i_L$ to build up as fast as it would without duty cycle profile 900, hence reducing current spikes, and limiting power losses. Duty cycle profile 900 walks in the current by turning on switches 330*a* and 330*b* simultaneously at intervals which are fractions of the duty cycle DT, and turning the switches off in between. Every period T the intervals increase in duration until the full duty cycle DT is reached at the end of the walk in. For example, if the circuit's steady state duty cycle DT is 45%, duty cycle profile 900 may, during first period 910, turn on switches 330*a* and 330*b* for 5% of the period, turn off, turn on for another 5% of the period, turn off, and so on until 45% duty cycle DT is reached. On second period 920, duty cycle profile 900 may turn on switches 330*a* and 330*b* for 10% of the period, turn off, turn on for another 10%, turn off, and so on until 45% duty cycle DT is reached. On third period 930, duty cycle profile 900 may increase the on-time intervals to 20%. On the last or $n^{th}$ period 940, the time interval reaches the full duty cycle DT, 45% in this example, and the current has been walked in. Duty cycle profile 900 may be implemented with duty cycle DT as the total on-time for the period or with DT as the cut-off time where switches 330*a* and 330*b* turn off until the start of the next period.

The on-time intervals in duty cycle profile 900 do not need to be of constant duration within a period T. For example, during the first period 910, the first interval may be 5% while the second on-time interval within the first cycle 910 may be 10%. The duration of time intervals may vary with specific duty cycle profiles. Duty cycle profiles, in turn, may vary depending on, for example, the size or type of fluorescent lamp, the application, and so on. Implementation of duty cycle profile 900 may reduce available duty cycle DT in order to account for the time that switches 330*a* and 330*b* are off, as well as for the turn-on and turn-off transition time. In one embodiment, switches 330*a* and 330*b* may be fabricated on the same semiconductor die or as part of the one device that contains both switches such that switches 330*a* and 330*b* have very similar to nearly identical switching characteristics. Having very similar to nearly identical switching characteristics allows switches 330*a* and 330*b* to turn on and off almost simultaneously.

Figure 4:
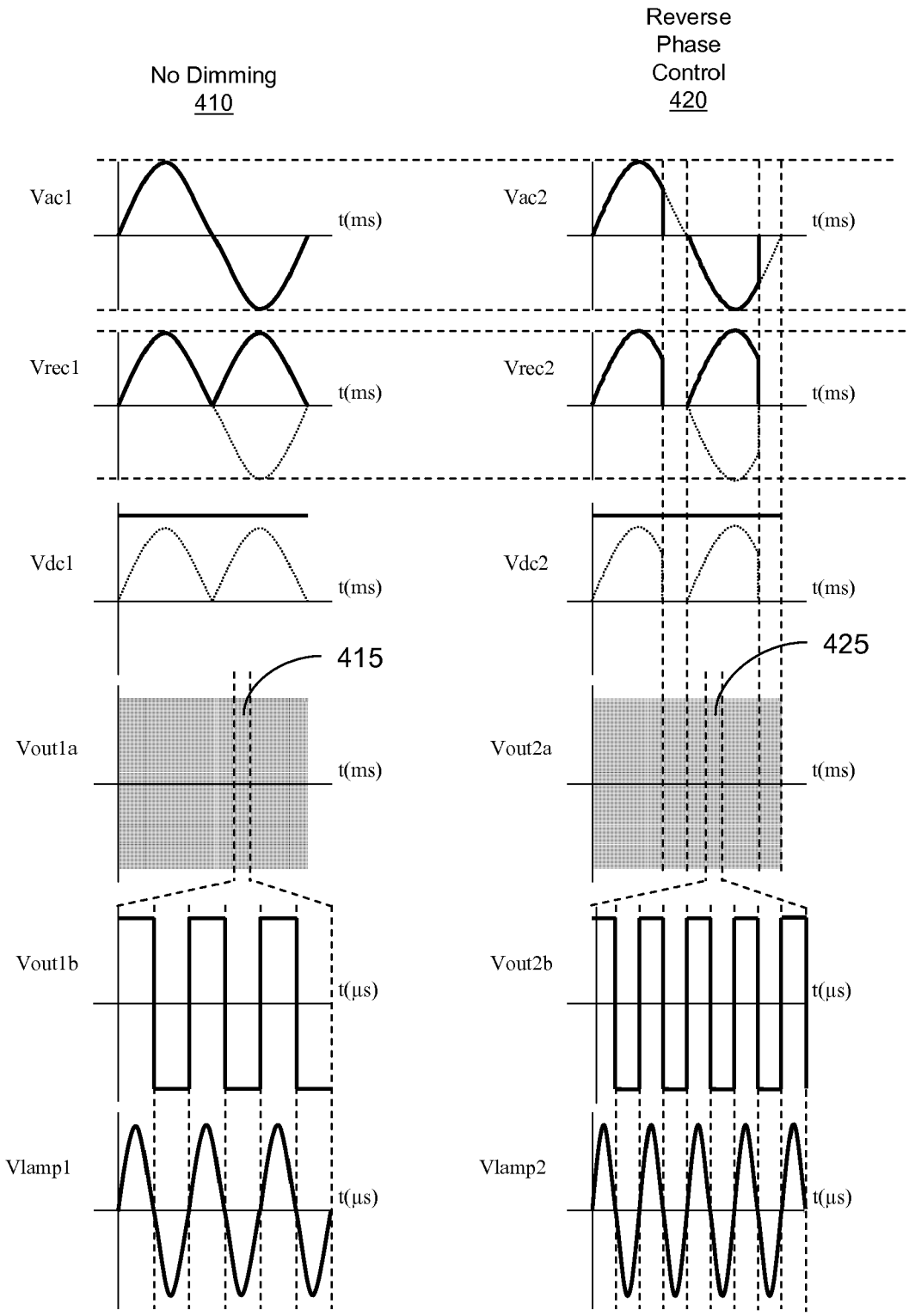
FIG. 4 illustrates example waveforms of various voltages of a fluorescent lamp dimming circuit connected to a reverse phase control dimmer.

FIG. 4 illustrates example illustrative waveforms of a fluorescent lamp dimming circuit. The first set of waveforms 410 illustrate operation when the dimmer is set to no dimming of the fluorescent lamp. Vac1 represents the AC input voltage to the fluorescent lamp dimming circuit. Vac1 is a sinusoidal voltage of line frequency and amplitude. Vrec1 represents the voltage waveform after full wave rectification. Voltage Vrec1 is DC voltage with high ripple. Vdc1 represents the output voltage of the PFC 130 stage. Vdc1 is DC voltage with very little ripple. The amplitude of Vdc1 is regulated by the PFC 130 circuitry. Vout1*a* represents the voltage at the output of IC 140 in the fluorescent lamp dimming circuit. It is the inversion of Vdc1 into an AC voltage.

The amplitude of Vout1*a* approximates the amplitude of Vdc1. The frequency of Vout1*a* is significantly higher than that of Vac1. During steady state operation of the fluorescent lamp dimming circuit, the frequency of Vout1*a* may be in the tenths or hundreds of kilohertz. This frequency is selected so that it is low enough for the circuit to operate efficiently, without excessive heat generation, but high enough so that the circuit operates above the resonance of the combination resonant tank 150 and fluorescent lamp 160. Waveform Vout1*b* represents a magnification of Vout1*a*, specifically area 415. Notice that the units of time in Vout1*b* are in microseconds versus milliseconds for Vout1*a*. Vout1*b* illustrates that the waveform at the output of IC 140 approximates a rectangular wave of amplitude substantially equal to Vdc1. Therefore, regulation of Vdc1 to a specific voltage also regulates the amplitude of Vout1*b* to substantially the same voltage. Since the transformer in resonant tank 150 has a fixed turns ratio, in steady state operation, regulating Vdc1 effectively regulates the amplitude of the lamp voltage Vlamp1. During times when the dimmer is set to no dimming, Vlamp1 may be set to a frequency, duty cycle and amplitude that maximizes the light output of lamp 160.

Many dimming applications are fitted with triac based dimmers, also known as phase chop dimmers. These dimmers work by removing or chopping parts of the AC input voltage waveform to the fluorescent lamp dimming circuit. Triac based dimmers come in at least two different types: forward phase control and reverse phase control.

FIG. 4 at 420 illustrates waveforms for a reverse phase control dimmer circuit operation in conjunction with an example fluorescent lamp dimming circuit. Vac2 illustrates the input voltage waveform to the example fluorescent lamp dimming circuit working in conjunction with an example reverse phase control dimmer. A reverse phase control dimmer removes or chops the voltage waveform Vac2 at a time later than the zero crossing. Thus, the user selected dimmer level proportionately changes the time between zero crossings of the input voltage waveform. Vrec2 illustrates the voltage waveform after full-wave rectification. PFC 130 may attempt to keep Vdc2 at a regulated voltage. In one embodiment, this regulated voltage Vdc2 is of constant value and independent of the dimmer setting. This means that the amplitude of Vdc2 would be the same as that of Vdc1 although the input waveform Vac2 is chopped while Vac1 is not. In another embodiment, the regulated voltage Vdc2 varies depending on the dimmer setting. This means that Vdc2 would be lower than Vdc1 in proportion to the difference between Vac1 and Vac2.

The amplitude of Vout2*a* approximates the amplitude of Vdc2. In one embodiment, to proportionately reflect the dimmer setting, the frequency of Vout2*a* is selected higher than the frequency of Vout1*a* which reflects no dimming. Again, waveform Vout2*b* represents a magnification of Vout2*a*, specifically area 425. Notice that the units of time in Vout2*b* are in microseconds versus milliseconds for Vout2*a*. In this embodiment, Vout2*b* has a selected frequency much higher than Vac2 and higher than the frequency of a no dimming situation as illustrated in Vout1*b*. The higher frequency of Vout2*b* is transmitted across resonant tank 150 to create Vlamp2. Notice that Vlamp2 has higher frequency than Vlamp1 causing the lamp to dim an amount proportional to the chopping of the Vac2 waveform. In an alternative embodiment the frequency, duty cycle, amplitude or a combination of the three may be varied to achieve the desired dimming.

Figure 5:
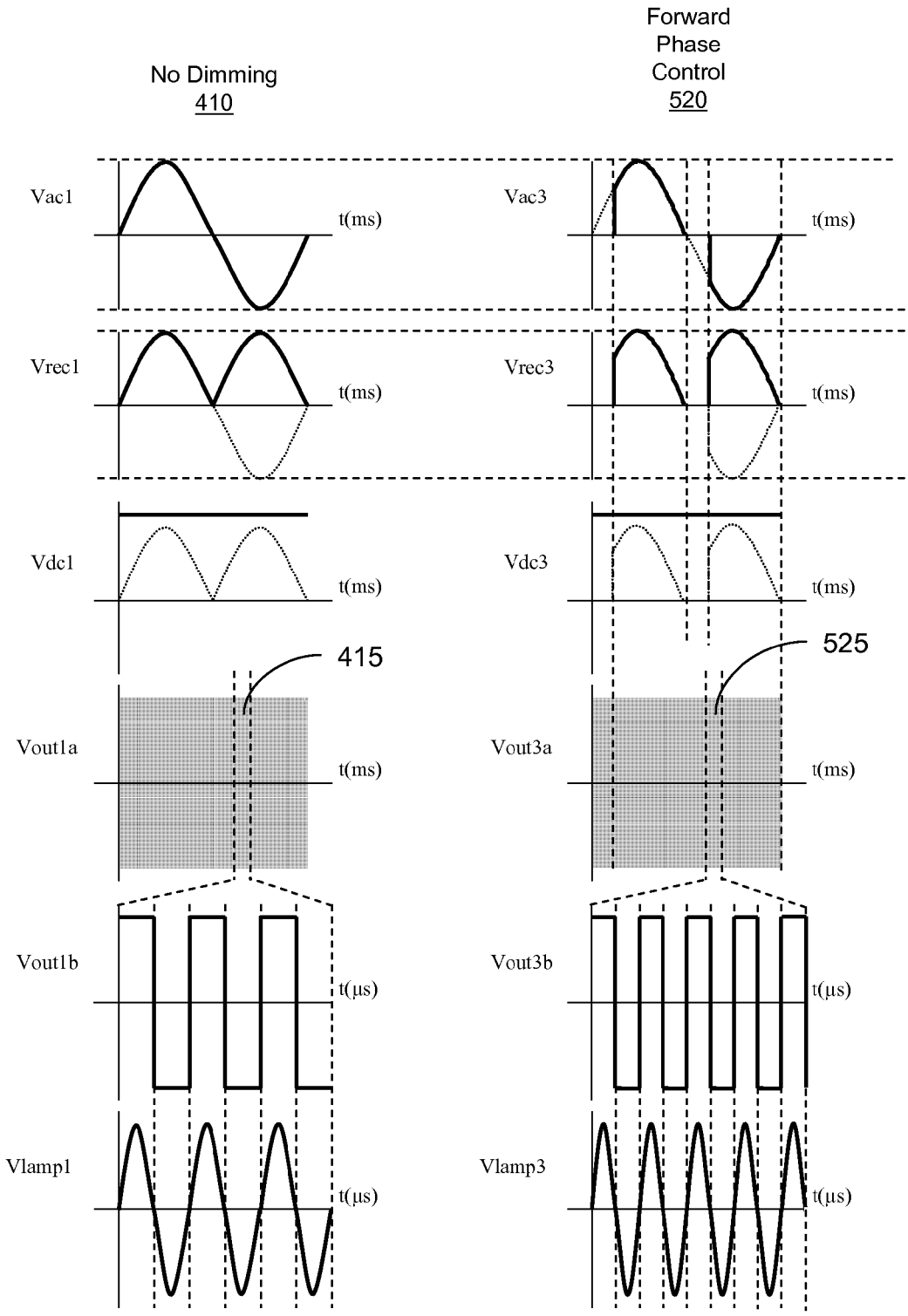
FIG. 5 illustrates example waveforms of various voltages of a fluorescent lamp dimming circuit connected to a forward phase control dimmer.

FIG. 5 at 520 illustrates waveforms for a forward phase control dimmer circuit operation in conjunction with an example fluorescent lamp dimming circuit. Vac3 illustrates the input voltage waveform to the example fluorescent lamp dimming circuit working in conjunction with a forward phase control dimmer. A forward phase control dimmer removes or chops the voltage waveform Vac3 at the zero crossing. Thus, the user selected dimmer level proportionately changes the time between zero crossings of the input voltage waveform. Vrec3 illustrates the voltage waveform after full-wave rectification. PFC 130 may attempt to keep Vdc3 at a regulated voltage. In one embodiment, this regulated voltage Vdc3 is constant and independent of dimming. This means that the amplitude of Vdc3 would be the same as that of Vdc1 although the input waveform Vac3 is chopped while Vac1 is not. In another embodiment, the regulated voltage Vdc3 may vary depending on the dimmer setting. This means that Vdc3 would be lower than Vdc1 in proportion to the difference between Vac1 and Vac3.

The amplitude of Vout3*a* approximates the amplitude of Vdc3. In one embodiment, to proportionately reflect the dimmer setting, the frequency of Vout3*a* is selected higher than the frequency of Vout1*a* which reflects no dimming. Waveform Vout3*b* represents a magnification of Vout3*a*, specifically area 525. Notice that the units of time in Vout3*b* are in microseconds versus milliseconds for Vout3*a*. In this embodiment, Vout3*b* has a selected frequency much higher than input Vac3 and higher than the frequency of a no dimming situation as illustrated in Vout1*b*. The higher frequency of Vout3*b* is transmitted across resonant tank 150 to create Vlamp3. Notice that Vlamp3 has higher frequency than Vlamp1 causing the lamp to dim an amount proportional to the chopping of the Vac3 waveform. In an alternative embodiment the frequency, duty cycle, amplitude or a combination of the three may be varied to achieve the desired dimming.

Figure 6:
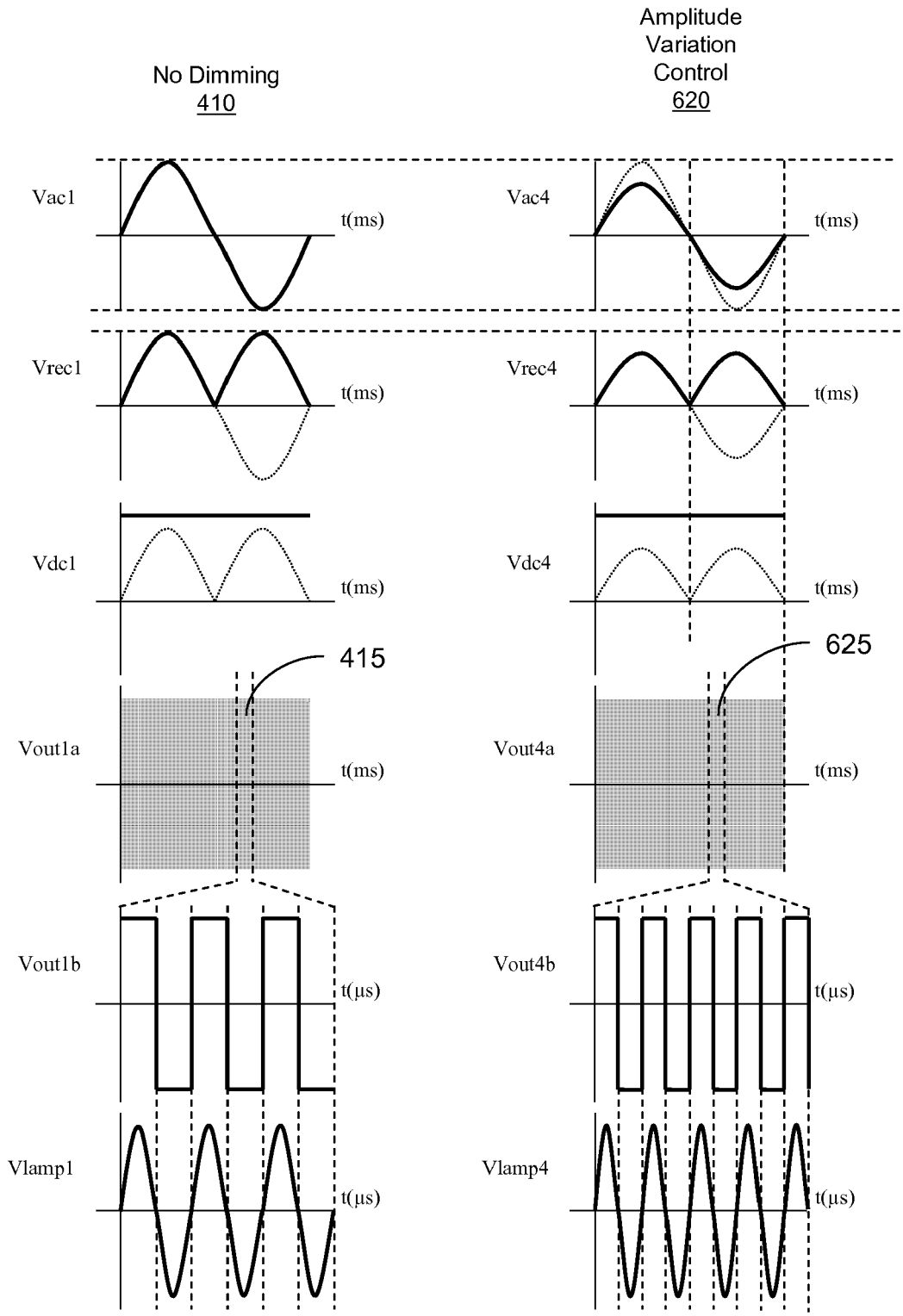
FIG. 6 illustrates example waveforms of various voltages of a fluorescent lamp dimming circuit connected to a amplitude variation dimmer.

FIG. 6 at 620 illustrates waveforms for an amplitude variation control dimmer circuit operation in conjunction with an example fluorescent lamp dimming circuit. Amplitude variation control works differently than phase control. Amplitude variation simply varies the amplitude of the AC input to the lamp based on the dimmer setting. Amplitude variation dimmers work well with incandescent lamps because a reduction in amplitude produces a reduction in light output. Amplitude variation dimmers do not work well to dim conventional fluorescent lamps because a reduction of voltage to the lamp beyond certain point extinguishes the lamp instead of dimming it. Vac4 illustrates the input voltage waveform to the example fluorescent lamp dimming circuit working in conjunction with an amplitude variation control dimmer. Vrec4 illustrates the voltage waveform after full-wave rectification. PFC 130 attempts to keep Vdc4 at a regulated voltage. In one embodiment, this regulated voltage Vdc4 is constant independently of dimming. This means that the amplitude of Vdc4 would be the same as that of Vdc1 although the input waveform Vac4 to the fluorescent lamp dimming circuit has lower amplitude than Vac1. In another embodiment, the regulated voltage Vdc4 varies depending on the dimmer setting. This means that Vdc4 would be lower than Vdc1 in proportion to the difference between Vac1 and Vac4.

The amplitude of Vout4*a* approximates to the amplitude of Vdc4. In one embodiment, to proportionately reflect the dimmer setting, the frequency of Vout4*a* is selected higher than the frequency of Vout1*a* which reflects no dimming. Waveform Vout4*b* represents a magnification of Vout4*a*, specifically area 625. Notice that the units of time in Vout4*b* are in microseconds versus milliseconds for Vout4*a*. In this embodiment, Vout4*b* has a frequency higher than that of the no dimming situation as illustrated in Vout1*b*. The higher frequency of Vout4*b* is transmitted across resonant tank 150 to create Vlamp4. Notice that Vlamp4 has higher frequency than Vlamp1 causing the lamp to dim an amount proportional to the lower amplitude of the Vac4 waveform compared to Vac1. In an alternative embodiment the frequency, duty cycle, amplitude or a combination of the three may be varied to achieve the desired dimmer setting.

Figure 7:
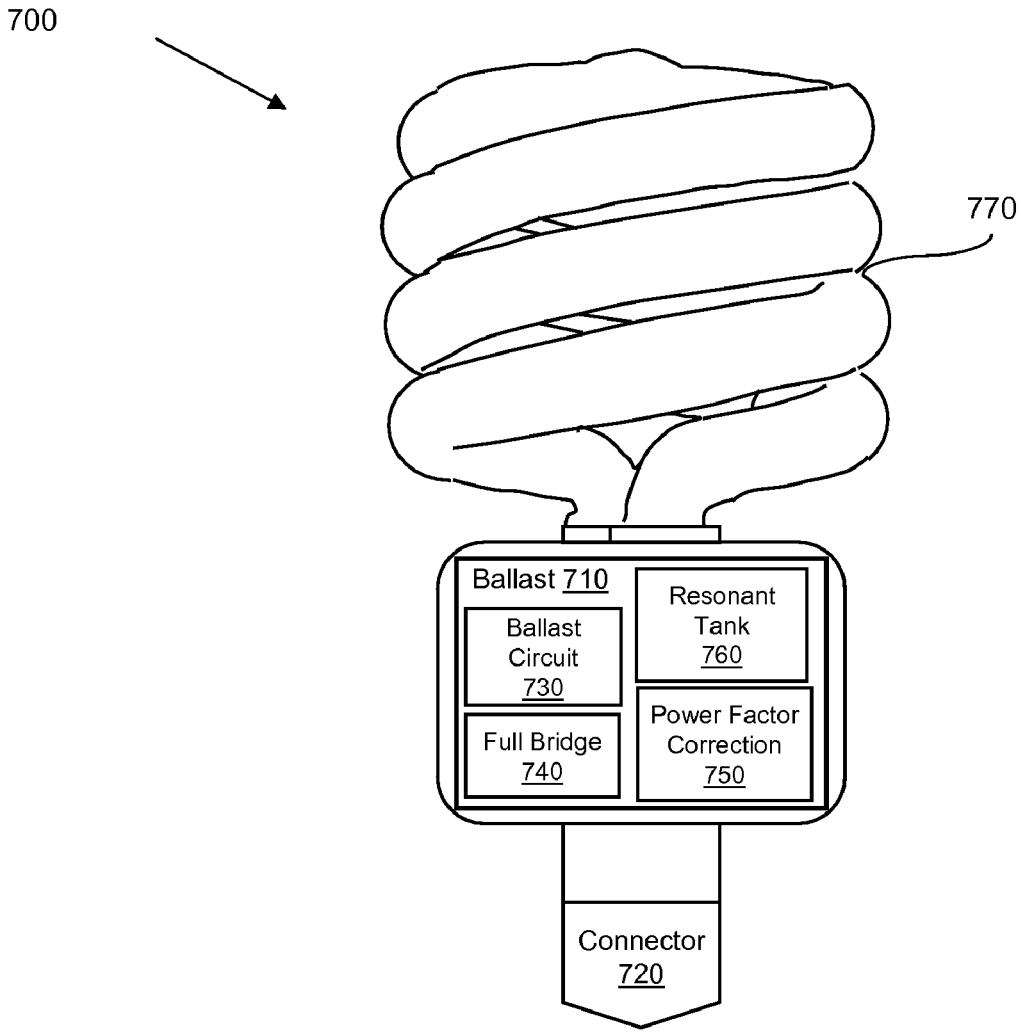
FIG. 7 illustrates an example fluorescent light bulb incorporating a dimming circuit.

FIG. 7 illustrates an example light bulb 700 configured with a dimmable ballast 710. Example light bulb 700 may have a connector end 720 that electrically and mechanically connects bulb 700 to an electrical socket. Connector end 720 may be one of many connector types known in the art (e.g. bayonet end, Edison screw base). Connector end 720 connects to the input of dimmable ballast 710. Dimmable ballast 710 may incorporate a full bridge rectifier 740, power factor correction circuitry 750, a ballast circuit 730, and a resonant tank 760. Example light bulb 700 also includes a fluorescent lamp 770 connected to the dimmable ballast 710.

Figure 8:
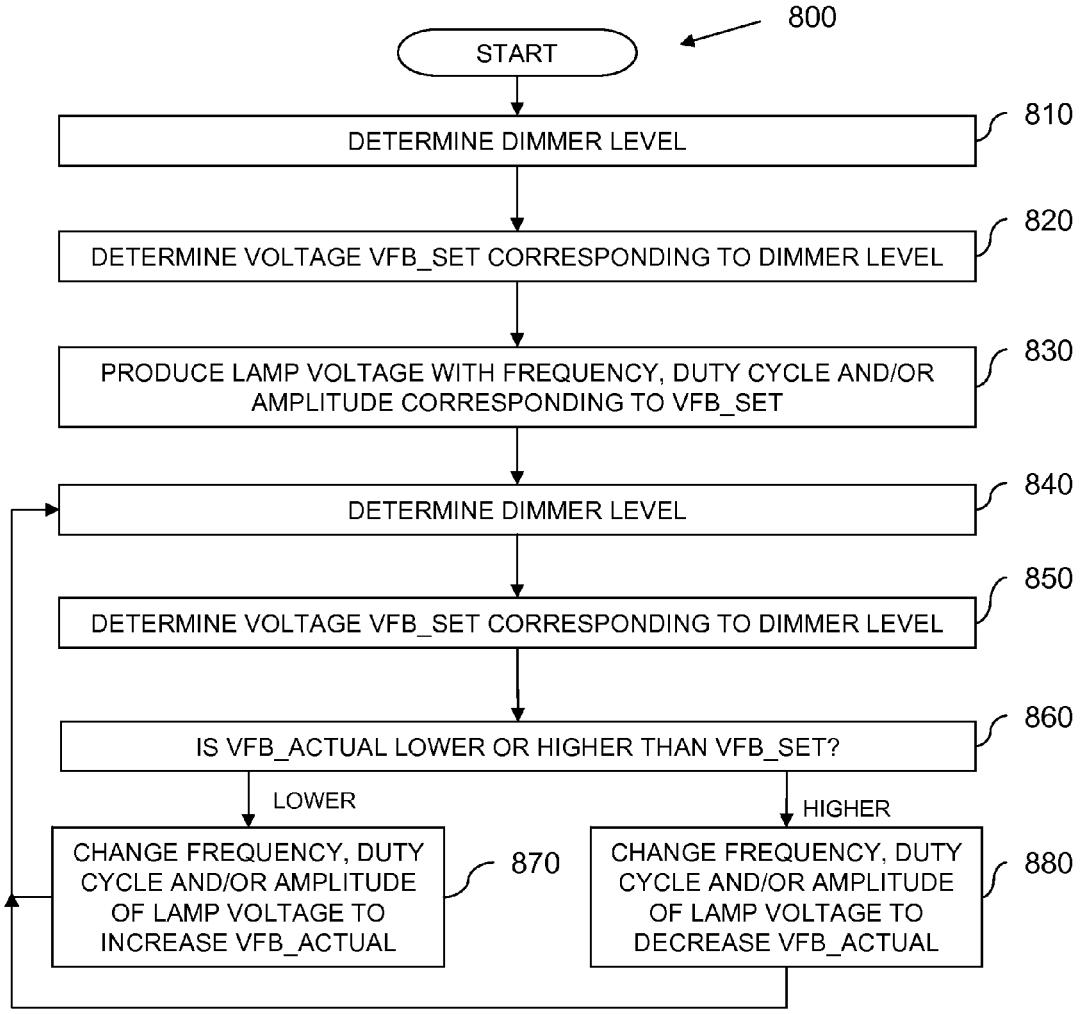
FIG. 8 illustrates an example method of dimming a fluorescent light bulb.

FIG. 8 illustrates an example method 800 for dimming a fluorescent lamp. At 810, method 800 determines or makes an assessment of a dimmer level based on at least one input including the input voltage to the fluorescent lamp dimming circuit. Assessing the input voltage may involve measuring time between zero crossings in the case where the dimmer connected to the fluorescent lamp dimming circuit is a forward or reverse phase control type dimmer. The dimmer level proportionately changes the time between zero crossings of the input voltage waveform. In another example, assessing the input voltage may involve measuring the peak voltage or the root mean square ("RMS") voltage of the input waveform. At 820, method 800 determines a voltage VFB_SET corresponding to the dimmer level determined at 810. Based on the determined VFB_SET, method 800 at 830 produces a lamp voltage with a frequency, duty cycle, and/or amplitude corresponding to VFB_SET. The lamp voltage, therefore, sets the light output of the lamp based on the input voltage.

At 840, method 800 once again determines the dimmer level based on the input voltage. At 850, method 800 determines voltage VFB_SET corresponding to dimmer level determined at 840. At 860, method 800 compares a voltage VFB_ACTUAL, a voltage equivalent to the lamp current, to VFB_SET. At 870, if VFB_ACTUAL is lower than VFB_SET, then method 800 changes the controlled parameters of the lamp voltage (e.g. frequency, duty cycle, amplitude) to increase VFB_ACTUAL. If however, VFB_ACTUAL is higher than VFB_SET, then method 800 at 880 changes the controlled parameters of the lamp voltage (e.g. frequency, duty cycle, amplitude) to decrease VFB_ACTUAL. Method 800 then returns to 840 to control the dimming level of the fluorescent lamp based on the dimmer setting in a closed loop control scheme.

What is claimed is:

1. A fluorescent lamp dimming circuit comprising:

a full-wave rectifier operatively connected to an input to the fluorescent lamp dimming circuit for rectifying an input AC voltage into a rectified DC voltage;

a power factor correction circuit operatively connected to the full-wave rectifier, the power factor correction circuit configured to produce a regulated DC buss voltage;

a multi-function integrated circuit operatively connected to the power factor correction circuit comprising:

a power factor control circuit for controlling the power factor correction circuit to produce the regulated DC buss voltage at a substantially constant voltage regardless of characteristics of the input AC voltage;

a dimming control circuit configured to receive the regulated DC buss voltage and the input AC voltage and produce a dimmer driver signal, where a set of parameters of the dimmer driver signal vary depending on the input AC voltage, the input AC voltage being modified by a dimmer; and one or more switching devices operatively connected to the dimming control circuit, the one or more switching devices driven by the dimmer driver signal and inverting the regulated DC buss voltage to a primary voltage, wherein the one or more switching devices are configured to turn on simultaneously and to turn off simultaneously at increasing intervals, the intervals being a fraction of a duty cycle, until the duty cycle is reached; and a resonant tank circuit comprising a transformer and a capacitor, the resonant tank configured to receive the primary voltage.

2. The fluorescent lamp dimming circuit of claim 1 where the set of parameters include one or more of a frequency and a duty cycle of the dimmer driver signal.

3. The fluorescent lamp dimming circuit of claim 1 where the dimming control circuit is configured to communicate to the power factor control circuit a regulation voltage for the regulated DC buss voltage, the regulation voltage varying depending on the input AC voltage.

4. The fluorescent lamp dimming circuit of claim 1 where the dimmer is one of a forward phase control dimmer, a reverse phase control dimmer, and an amplitude variation control dimmer.

5. The fluorescent lamp dimming circuit of claim 1 where the one or more switching devices are one of metal oxide semiconductor field effect transistors, bipolar junction transistors, and insulated gate bipolar transistors.

6. A dimmable compact fluorescent light bulb comprising:

a connector end for operatively connecting the dimmable compact fluorescent light bulb to an electrical socket; and an electronic ballast circuit operatively connected to the connector end, the electronic ballast circuit comprising:

an AC to DC converter for converting an AC voltage from the electrical socket to a DC voltage;

a power factor correction circuit operatively connected to the AC to DC converter for correcting power factor and establishing a regulated DC buss voltage;

a multi-function integrated circuit operatively connected to the power factor correction circuit comprising, a power factor control circuit for controlling the power factor correction circuit in response to a sensed condition of the regulated DC buss voltage and the AC voltage from the electrical socket;

a dimming control circuit for controlling dimming of the dimmable compact fluorescent light bulb by varying the frequency of a drive signal based on the AC voltage from the electrical socket; and one or more switching devices operatively connected to the dimming control circuit and driven by the drive signal for converting the regulated DC buss voltage to a primary AC voltage waveform, wherein the one or more switching devices are configured to turn on simultaneously and to turn off simultaneously at increasing intervals, the intervals being a fraction of a duty cycle, until the duty cycle is reached; and a resonance circuit comprising a transformer and a capacitor, the resonance circuit including a compact fluorescent lamp, the resonance circuit operatively connected to the integrated circuit, the primary AC voltage waveform being applied to the resonance circuit to power the compact fluorescent lamp.

7. The dimmable compact fluorescent light bulb of claim 6 where the dimming control circuit communicates with the power factor control circuit to vary the regulated DC buss voltage based on the AC voltage from the electrical socket.

8. The dimmable compact fluorescent light bulb of claim 6 where the connector end is one of a bayonet end and an Edison screw base end.

* * * * *